US007278873B2

(12) United States Patent
Langhoff et al.

(10) Patent No.: US 7,278,873 B2
(45) Date of Patent: Oct. 9, 2007

(54) PLUG SYSTEM FOR ELECTRICAL PLUG CONNECTORS WITH LATCHING DEVICE

(75) Inventors: Wolfgang Langhoff, Leonberg (DE); Alfred Annecke, Heilbronn (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 11/376,192

(22) Filed: Mar. 16, 2006

(65) Prior Publication Data

US 2006/0216983 A1 Sep. 28, 2006

(30) Foreign Application Priority Data

Mar. 24, 2005 (DE) ..... 10 2005 013 633

(51) Int. Cl.
*H01R 13/627* (2006.01)

(52) U.S. Cl. ..... 439/352

(58) Field of Classification Search ..... 439/352, 439/188, 489

See application file for complete search history.

(56) References Cited

U.S. PATENT DOCUMENTS

| | | | | |
|---|---|---|---|---|
| 4,720,157 | A | 1/1988 | Nestor et al. | |
| 5,120,255 | A | 6/1992 | Kouda et al. | |
| 6,276,953 | B1 * | 8/2001 | Gauker et al. | 439/352 |
| 6,402,540 | B1 * | 6/2002 | Kuhmel et al. | 439/378 |
| 6,464,526 | B1 * | 10/2002 | Seufert et al. | 439/352 |
| 6,491,542 | B1 | 12/2002 | Zerebilov | |
| 6,530,799 | B2 * | 3/2003 | Regnier et al. | 439/352 |
| 6,544,060 | B2 * | 4/2003 | Wakui et al. | 439/188 |
| 6,659,789 | B2 * | 12/2003 | Nagamine et al. | 439/352 |
| 6,699,059 | B2 * | 3/2004 | Nagamine et al. | 439/352 |
| 6,893,277 | B2 * | 5/2005 | Parrish et al. | 439/188 |
| 6,964,579 | B2 * | 11/2005 | Seminara et al. | 439/352 |
| 7,014,490 | B1 * | 3/2006 | Morikawa et al. | 439/352 |

FOREIGN PATENT DOCUMENTS

| | | |
|---|---|---|
| DE | 196 21 762 A1 | 1/1997 |
| DE | 195 25 413 A1 | 1/1998 |
| DE | 102 25 970 A1 | 1/2003 |
| EP | 0 732 775 A2 | 9/1996 |

OTHER PUBLICATIONS

European Search Report, dated May 17, 2006.

* cited by examiner

*Primary Examiner*—Chandrika Prasad
*Assistant Examiner*—Harshad C Patel
(74) *Attorney, Agent, or Firm*—Blank Rome LLP

(57) ABSTRACT

A plug-in system with an electrical pin-and-socket connector and a plug-in base for the connection of the electrical pin-and-socket connector with the plug-in base during the contact of a connector of the plug-in base with a socket of the electrical pin-and-socket connector, whereby to increase the connection safety and ease of operation in connection while maintaining low production costs a latching of a latch of the plug-in base casing with a locking joint bar of the pin-and-socket casing is achieved by a secondary latching device guided on an outer contour of the pin-and-socket connector.

19 Claims, 5 Drawing Sheets

PLUG SYSTEM FOR ELECTRICAL PLUG CONNECTORS WITH LATCHING DEVICE

RELATED APPLICATION

This Application claims the benefit under 35 U.S.C. § 119 of German Application No. 10 2005 013 633.8, filed Mar. 24, 2005.

FIELD OF THE INVENTION

The invention concerns a plug-in system with an electrical pin-and-socket connector and a plug-in base for the frictional connection of electrical pin-and-socket connectors with the plug-in base during the contact of a connector of the plug-in base with a socket of the electrical pin-and-socket connector.

BACKGROUND OF THE INVENTION

Plug-in systems for the manufacture of a pin-and-socket connector, and especially the latching device of the pin-and-socket connector, exist in a variety of variants, whereby, for example, the latching device can be formed as a joint bar that overlaps a corresponding latch.

For use under rough environmental conditions, which, for example, occur in the automobile industry (vibrations, mechanical stress from shock, long vehicle life) there is a need to provide proven electrical pin-and-socket connectors with an additional latching device that additionally rules out operator error to the greatest possible extent.

To the extent that secondary latching devices are known in the prior art, they generally serve to prevent contact of the pin-and-socket connector until the secondary latching device is locked into place. Such secondary latching devices occur, for example, in airbag pin-and-socket connectors, whereby it is primarily a matter of avoiding a misfire in these special pin-and-socket connectors.

In traditional pin-and-socket connectors it is nevertheless important to insure a high conductivity with a safer contact of the connector and counter-connector and in this way to facilitate the most cost-efficient fabrication of the electrical pin-and-socket connector possible. In addition, the operation should be as simple as possible and if necessary a visual control of the correct plug-in connection should be possible.

SUMMARY OF THE INVENTION

Therefore the object of the invention is to provide for an improved plug-in system with, on the one hand, higher plug-in security and, on the other hand, easier operability in connection with low production costs.

The basic idea of the present invention is to attach a secondary latching device, which is at least partly designed so it is springable, to a locking joint bar of an electrical pin-and-socket connector, whereby pushing the secondary latching device into the locking position first through a latch of the counter-connector or plug-in base is enabled/released when the counter-connector is completely pushed into the electric connector. The latch is preferably designed so that it at the same time provides for a locking of the counter-connector in the pin-and-socket connector casing. In its secondary locking position the secondary latching device prevents the guiding groove of the counter-connector from becoming disengaged by limiting the spring movement of the locking joint bar of the connector casing.

In its most general working form the plug-in system of this type has the following characteristics:

a pin-and-socket casing with at least one locking joint bar a corresponding plug-in base a secondary latching device guided on an outer contour of the pin-and-socket casing to lock a latch of the plug-in base with a locking joint bar.

In a preferred embodiment of the invention an arm of the secondary latching device extends in the insertion direction S of the electrical pin-and-socket connector, and is positioned so it is directed, in particular, to be countercurrent or opposite to a guide rib. The secondary latching device is especially easy to lock when the arm is slid into the pin-and-socket casing, especially on the locking joint bar.

By designing the locking joint bar and/or arm so it is springable, the primary lock of the latch can lock by snapping the latch into a corresponding form of the locking joint bar.

In a further embodiment of the invention a plug-in system is provided in which the pin-and-socket casing has at least one guide groove, especially a circulating guide groove, for receiving the corresponding guide rib.

In another embodiment of the invention a plug-in base casing is provided that is movable in a primary latching position in the pin-and-socket connector casing when the secondary latching device is in a preassembled position in which the arm with its arm end lying in the insertion direction S is adjacent to a locking joint bar catch.

By forming the locking joint bar catch through a recess that is positioned in the area of the end lying in the insertion direction S of the locking joint bar, the invention is further structurally simplified and the locking joint bar catch is formed at the same time through the side wall of the recess lying in the insertion direction S.

A guide groove for the guide rib is provided in the pin-and-socket casing, and in a specific embodiment of the invention the guide groove is designed in such a way that the locking joint bar is positioned in the primary latching position between the arm and the guide rib. Essentially the primary and secondary locking is brought about through these three structural components, whereby the primary locking is brought about against the insertion direction and the secondary locking can be brought about in the insertion direction only later.

In this connection, in a further embodiment of the invention the latch, the arm end, and the recess can be positioned in the primary locking position in the insertion direction S at an approximately equal height or level and the latch and the arm end from opposite sides engage in the recess. When reaching the primary locking position, the latch snaps into the recess and at the same time presses the arm end of the arm out of the recess and releases it.

Pushing the plug-in base into the connector is made considerably easier when the latch has a ramp for rebounding the locking joint bar.

The described plug-in system can also provide that the secondary latching device is movable in the pocket of the pin-and-socket casing and secondary locking position and in this way a rebounding of the locking joint bar, and with it a release of the latch from the recess, is prevented.

Further, the socket can be designed as a radial contact socket, which has several longitudinal contact elements rotated in hyperbolic form. When the connector is inserted, axial rods are bent away in the socket half, which allows for high conduction with a minimal fall in voltage through the connection. The configuration of the hyperbolic stamped catches guarantees that the coaxially opposite surfaces are largely covered. Because the resistance depends chiefly on contact, the normal force of the surface, and the surface conditions, the best possible contact is obtained through a pin-and-socket connector designed as such. The variety of surfaces of the flat grid guarantees the largest possible surface contact with the matching connector. The reduced contact pressure creates negligible wear for a long life. The insertion force can, moreover, be adapted to any demand by changing the torsion applied on the inner grid.

Because of the smaller total contact resistance, little heat arises so that at a given temperature limit higher currents are possible. Furthermore, the system inertia is minimized through the small casing and the fact that the contact displays an elastic force, as a result of which such pin-and-socket connectors withstand extreme vibrations and impact shocks independent of their direction and intensity.

BRIEF DESCRIPTION OF THE DRAWINGS

Further designs of the invention follow from the patent claims, the figures and the accompanying description of the figures whereby the figures of the drawing represent the following:

DETAILED DESCRIPTION OF THE INVENTION

Figure 1:
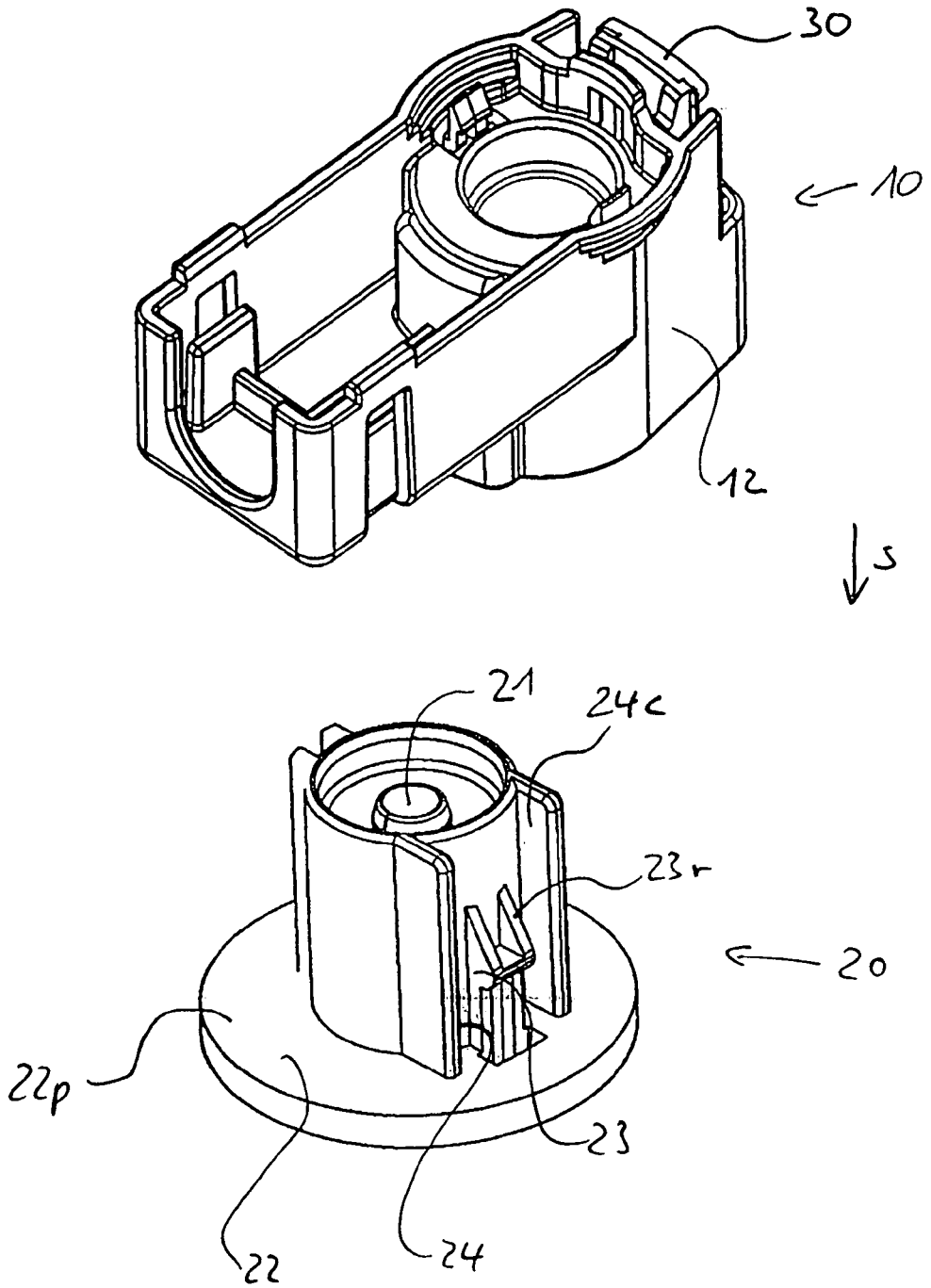
FIG. 1: a perspective view of the plug-in system

FIG. 1A shows an electrical pin-and-socket connector 10 with a secondary latching device 30 in a preassembled state. The electrical pin-and-socket connector 10 essentially consists of an L-shaped pin-and-socket connector casing 12, on which a cover 12*d*, (shown in FIGS. 2, 3, and 4) can be placed, which essentially locks the casing.

FIG. 1B shows a plug-in base 20—distorted and not shown in alignment—which has a connector 21.

The plug-in base 20 consists of a mushroom-shaped plug-in base 22. From the base plate 22*p* a cylinder-shaped guide rib 24 essentially extends vertically with encoded ribs 24*c* formed on it. The guide rib 24 provides for torsional safety and proper orientation of the plug-in base 20 with the electrical pin-and-socket connector 10 during insertion.

On the outer side of the guide rib 24 a latch 23 is formed, which has a ramp 23*r* against the insertion direction of the electrical pin-and-socket connector 10, on which a locking joint bar 13 (shown in FIG. 2) slides along its slanted end during insertion of the electrical connector 10 with the plug-in base 20 and in the primary locking position finally grasps the latch from behind through the spring action of the locking joint bar 13, which is designed so that it is springable. The latch 23 lies in the primary locking position, as seen in FIG. 3, level with recess 15 of the locking joint bar 13. In this way the primary latching device is closed and the relative position of the electrical pin-and-socket connector 10 and plug-in base 20 to one another does not change anymore.

Figure 2:
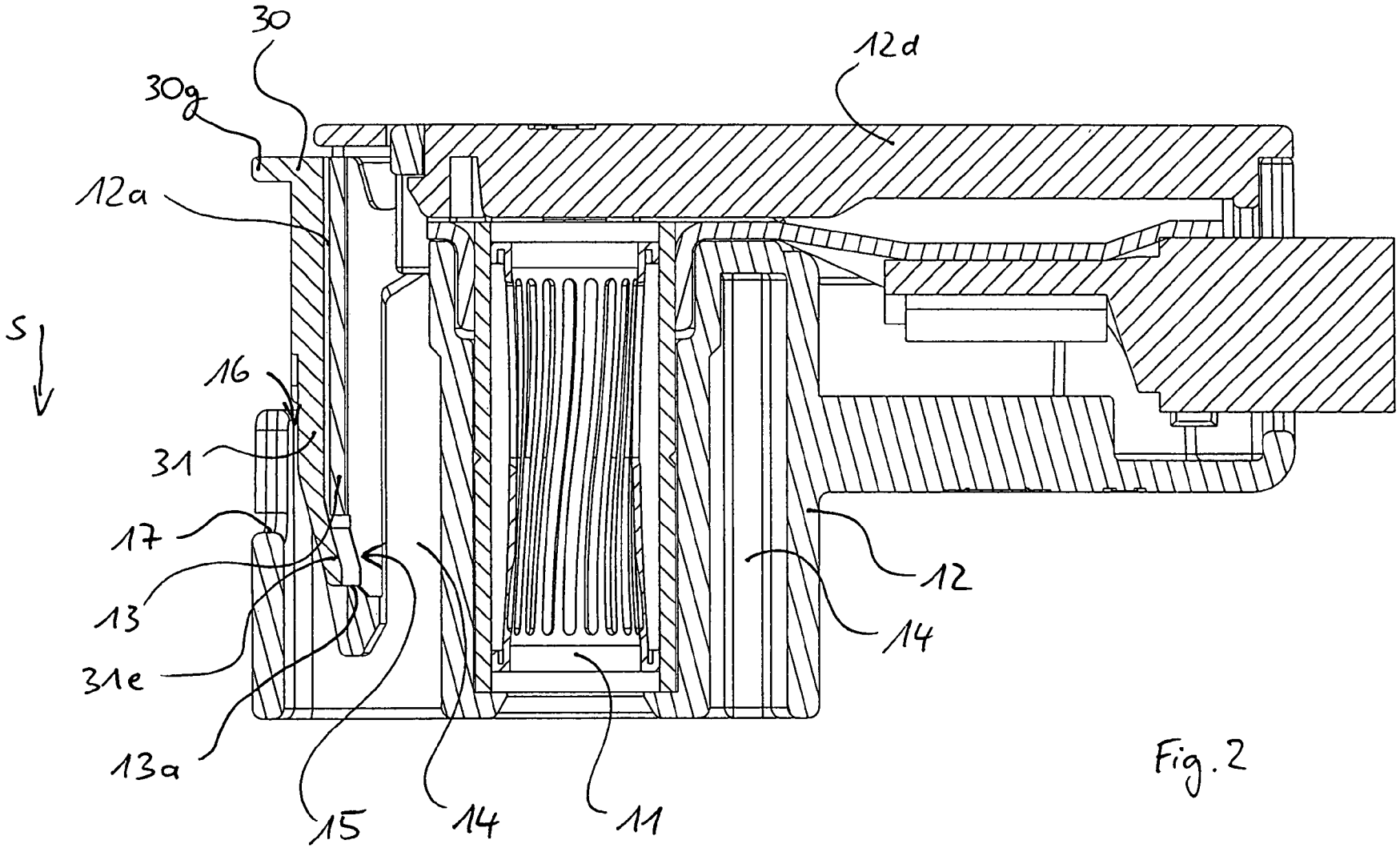
FIG. 2: a cut-out side view of the electrical pin-and-socket connector in a pre-assembled state
Figure 3:
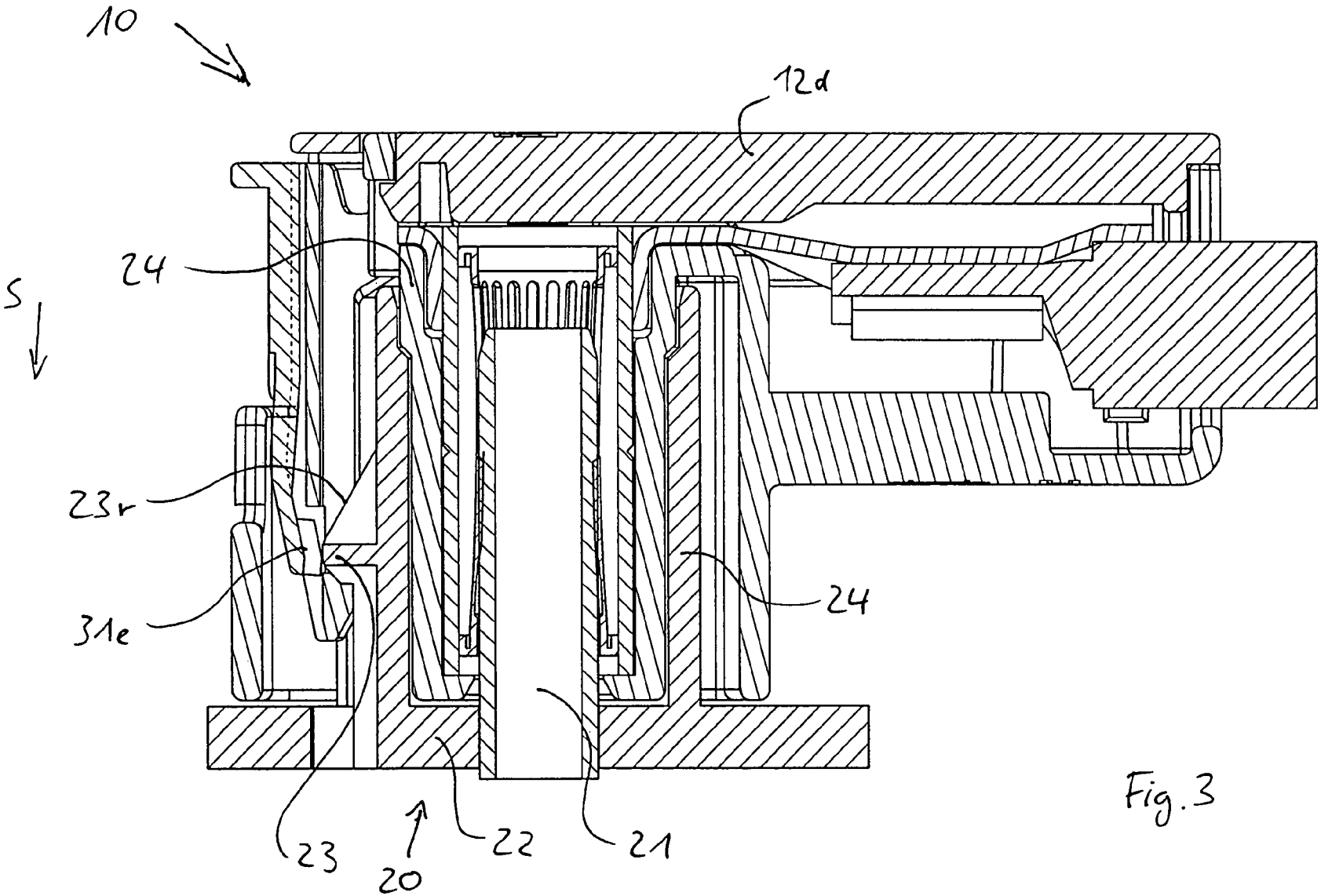
FIG. 3: a cut-out side view of the electrical pin-and-socket connector with plug-in base in the primary locking position
Figure 4:
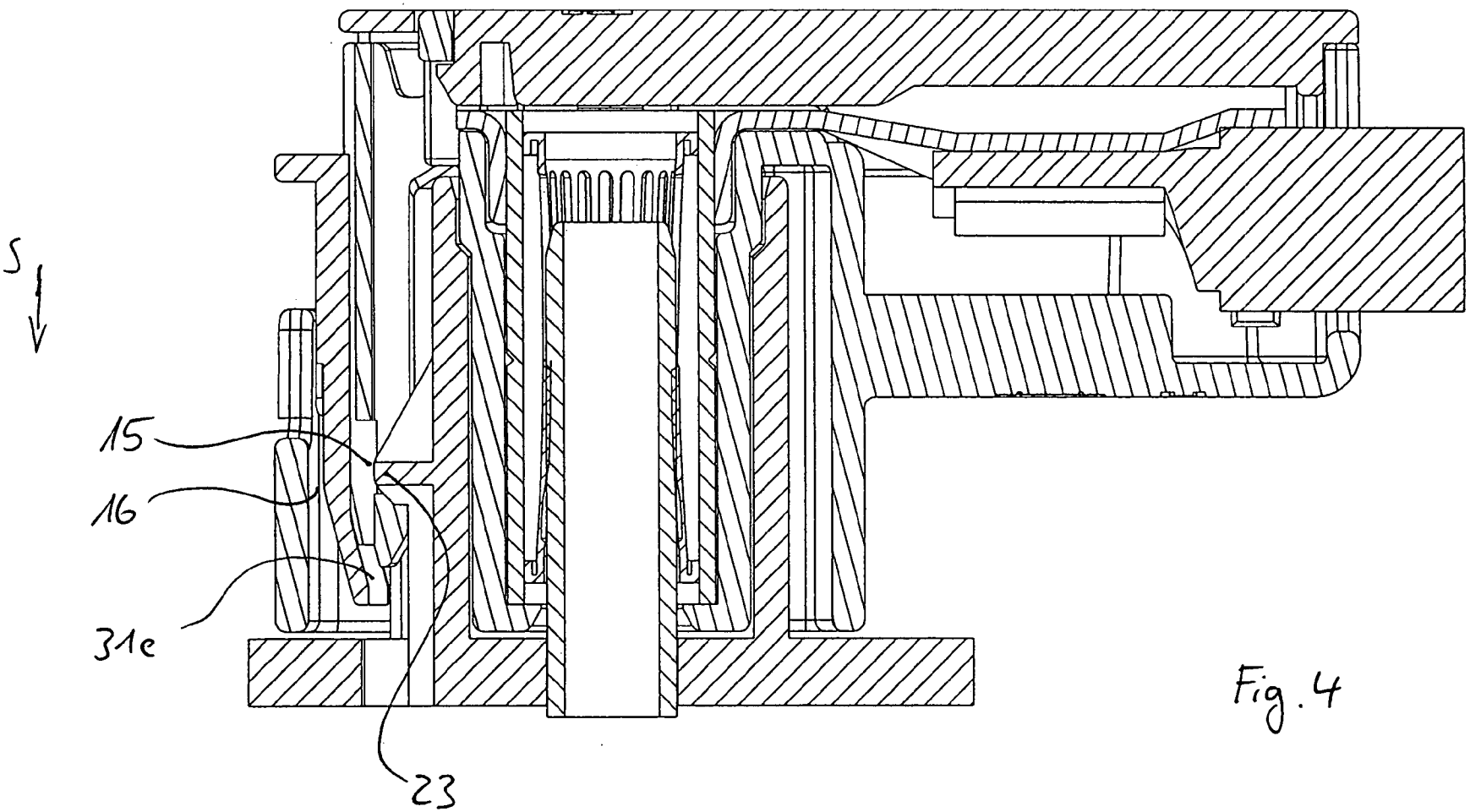
FIG. 4: a cut-out side view of the plug-in system in the secondary locking position

In FIGS. 2, 3, and 4 the plug-in system in the three states or positions essential to the invention are shown in cross section, whereby the cross section line (not shown) essentially runs through the center axis of the plug-in system.

Socket 11 is designed as a radial contact socket, which has several longitudinal elements curved in hyperbolic form. The socket 11 stays in conductive contact with the line terminal on the pin-and-socket connector side. It is worth noting that in reality the pin-and-socket connector shown here has dimensions of only a few millimeters and accordingly process tolerances play a considerable role. All the more it is an object of the structural design of the latching mechanism to obtain a safer locking/latching of the electrical pin-and-socket connector 10 and plug-in base.

On an outer contour 12*a*, in this case the front of the L-shaped pin-and-socket connector casing 12, a secondary latching device 30 is formed so it slides, whereby a sliding motion through the structural design of the secondary latching device 30 and the pin-and-socket casing 12 is possible exclusively along the insertion direction S of the electrical pin-and-socket connector 10. Furthermore, the arm 31 of the secondary latching device 30, which also extends in the insertion direction S, is designed so it is springable, whereby the springiness essentially runs orthogonal to the insertion direction in the direction of the longitudinal axis of the pin-and-socket connector 10. On the end of the arm 31 lying in the insertion direction S an arm end 31*e* is provided, which locks into the recess 15 of the locking joint bar 13 in the preassembled position, shown in FIG. 2. Pushing the secondary latching device 30 into the preassembled position is not possible due to the blocking action against the arm end 31*e* by the locking joint bar catch 13*a*.

The catch point can also be formed in every design of the secondary locking device 30 in which the relative motion of the secondary locking device 30 is blocked along the insertion direction S until the latch 23 reaches the primary locking position. In particular, the catch must not necessarily occur at the end of the arm 31.

The secondary latching device 30 can be reached and operated easily from the outside by means of a handle 30*g*, which projects orthogonally to the insertion direction S of the secondary latching device 30. In the area of the arm end 31*e* the secondary latching device 30 is sunk in a corresponding pocket 16 of the pin-and-socket casing 12.

As soon as the primary latching position shown in FIG. 3—as described above—is reached and both the locking joint bar 13, designed to be springable, and the adjacent arm 31, designed to be springable, spring back in the direction of the latch 23, the arm end 31*e* is prevented from springing back into the recess 15 by the latch 23. Because of this, the movement of the secondary latching mechanism 30 in the insertion direction S is no longer prevented by the locking joint bar catch 13*a* and it is possible to push the secondary latching device 30 in the insertion direction S and thus into the secondary latching position.

The secondary latching position is shown in FIG. 4. It is easy to see that through the design of the pocket 16 a rebounding of the arm 31 and thus the locking joint bar 13 is prevented.

Figure 5:
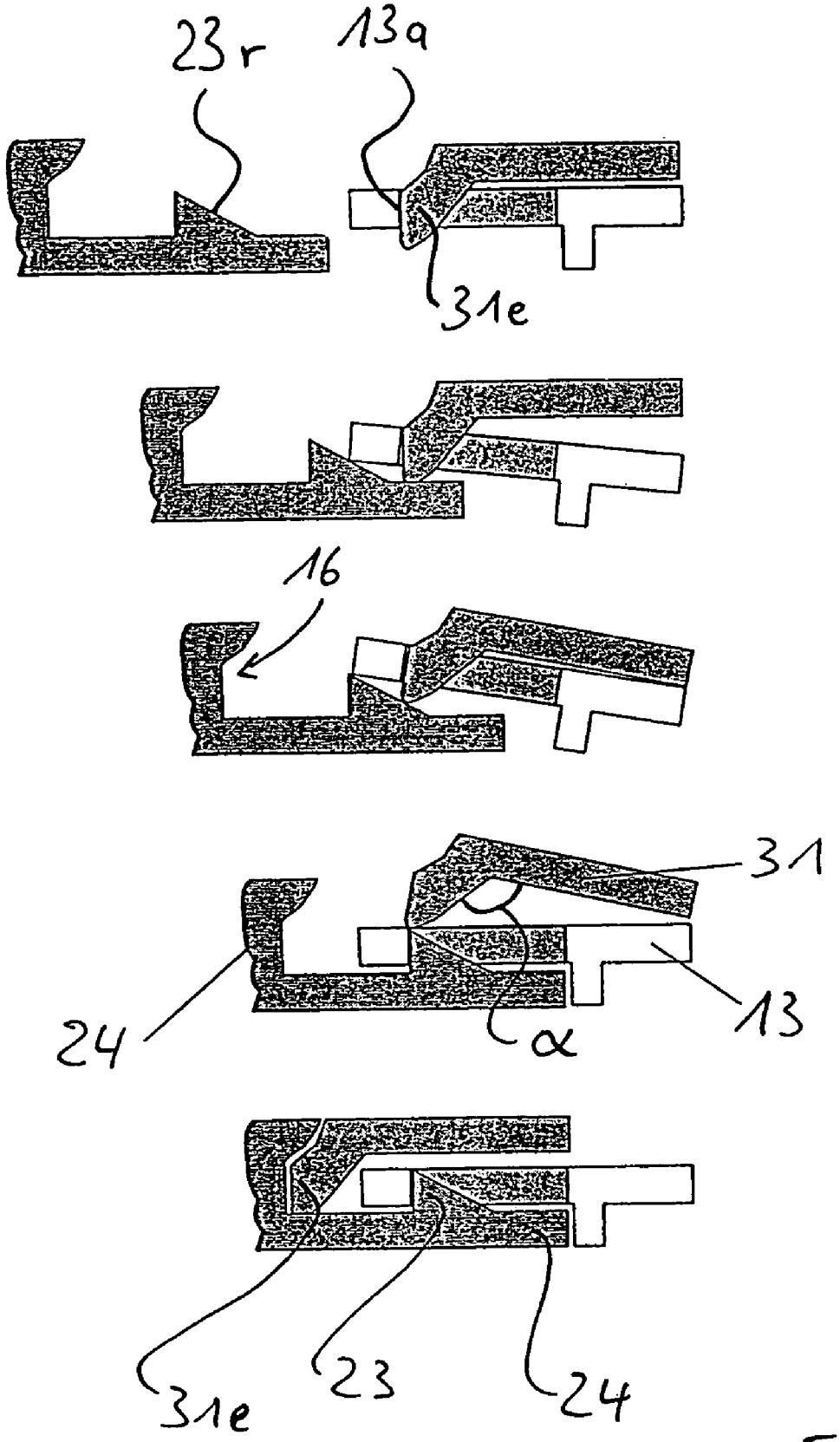
FIG. 5: a diagrammatic representation of the operational principle according to the invention.

The pocket 16 can be formed similarly in an alternative embodiment through the plug-in base casing 22, as is shown in FIG. 5. In FIG. 5 the essential positions of the structural components (latch 23, locking joint bar 13, arm 31) that bring about the primary and secondary latching are shown. The force needed to release the secondary locking device can be adjusted through various sharp tilting (angle $\alpha$) of the arm end 31*e* with respect to arm 31. Through the design of the pocket 16, shown in FIG. 5, and the corresponding design of the arm end 31*e*, a restricted guiding of the secondary latching device is obtained through the engagement in the secondary latching position and with it a compensation of the possible relaxation effect.

LIST OF REFERENCE NUMBERS

S: insertion direction
20: electrical pin-and-socket connector
21: socket
22: pin-and-socket connector casing
12*a:* outer contour
12*d:* cover
10: locking joint bar
13*a:* locking joint bar catch
10: guide groove
11: recess
12: pocket
13: catch
14: plug-in base
15: connector
16: plug-in base casing
22*p:* base plate
20: latch
23*r:* ramp
20: guide rib
24*c:* encoded rib
30: secondary locking device
30*g:* handle
30: arm
31*e:* arm end

The invention claimed is:

1. A plug-in system with an electrical pin-and-socket connector and a plug-in base with the plug-in base having a connector engageable with a socket of the electrical pin-and-socket connector, wherein the plug-in system comprises:

a casing of the electrical pin-and-socket connector with at least one locking joint bar;

a casing of the plug-in base corresponding to the casing of the electrical pin-and-socket connector; and a secondary latching device guided on an outer contour of the casing of the electrical pin-and-socket connector for locking a latch of the casing of the plug-in base with the locking joint bar, wherein the latch has a ramp for the rebounding of the locking joint bar.

2. The pin-and-socket system according to claim 1, wherein the secondary latching device has an arm, which extends in the insertion direction of the electrical pin-and-socket connector.

3. The plug-in system according to claim 2, wherein the arm and a guide rib, which is formed on the latch, are positioned counter-current.

4. The plug-in system according to claim 2, wherein the arm is guided so it slides in the casing of the electrical pin-and-socket connector.

5. The plug-in system according to claim 2, wherein the arm is guided so it slides on the locking joint bar.

6. The plug-in system according to claim 1, wherein the locking joint bar is springable.

7. The plug-in system according to claim 1, wherein the arm is springable.

8. The plug-in system according to claim 1, wherein the casing of the electrical pin-and-socket connector has at least one circular guide groove to receive the corresponding guide rib.

9. The plug-in system according to claim 1, wherein the plug-in base is moveable in a primary latching position in the casing of the electrical pin-and-socket connector when the secondary latching device is located in a preassembly position, in which an arm end of an arm of the secondary latching device, lying in an insertion direction, adjoins a locking joint bar catch.

10. The plug-in system according to claim 9, wherein the locking joint bar catch is formed by a recess positioned in an end of the locking joint bar.

11. The plug-in system according to claim 9, wherein the locking joint bar is positioned in the primary latching position between the arm and the guide rib.

12. The plug-in system according to claim 9, wherein the latch, the arm end, and the bar catch are positioned in the primary latching position in the insertion direction at substantially the same level.

13. The plug-in system according to claim 12, wherein the latch and the arm end lock in a recess of locking joint bar from opposite sides.

14. The plug-in system according to claim 13, wherein the latch is designed in such a way that the arm end releases from the primary latching position, and the secondary latching device is further movable in the insertion direction.

15. The plug-in system according to claim 10, wherein the secondary locking device is movable in a pocket between the casing of the pin-and-socket electrical connector and the locking joint bar and thus a release of the latch from the recess is prevented.

16. The plug-in system according to claim 1, wherein the socket is designed as a radial contact socket.

17. The plug-in system according to claim 16, wherein the socket has several longitudinal contact elements rotated in hyperbolic form.

18. The plug-in system according to claim 1, wherein the secondary latching device is slideable with respect to the casing.

19. The plug-in system according to claim 1, wherein the locking joint bar includes a recess;

an end of the secondary latching device being receivable in the recess when in a preassembly position; and a portion of the latch being receivable in the recess when the latch is locked with the locking joint bar.

* * * * *

UNITED STATES PATENT AND TRADEMARK OFFICE

CERTIFICATE OF CORRECTION

PATENT NO. : 7,278,873 B2
APPLICATION NO. : 11/376192
DATED : October 9, 2007
INVENTOR(S) : Langhoff et al.

It is certified that error appears in the above-identified patent and that said Letters Patent is hereby corrected as shown below:

In col. 3, under title DETAILED DESCRIPTION OF THE INVENTION, delete lines 38-45 and replace with the following:

--FIG. 1 shows an electrical pin-and-socket connector 10 with a secondary latching device 30 in a preassembled state and a plug-in base 20. The electrical pin-and-socket connector 10 has an L-shaped pin-and-socket connector casing 12, on which a cover 12*d*, (shown in FIGS. 2, 3, and 4) can be placed, which essentially locks the casing.--

Signed and Sealed this
Third Day of May, 2011

David J. Kappos

David J. Kappos
*Director of the United States Patent and Trademark Office*